US008910406B1

(12) United States Patent
Huang et al.

(10) Patent No.: US 8,910,406 B1
(45) Date of Patent: Dec. 16, 2014

(54) VENTED UPPER RECEIVER FOR A FIREARM

(71) Applicants: George Huang, Henderson, NV (US); Paul Oglesby, Darley (GB)

(72) Inventors: George Huang, Henderson, NV (US); Paul Oglesby, Darley (GB)

( * ) Notice: Subject to any disclaimer, the term of this patent is extended or adjusted under 35 U.S.C. 154(b) by 0 days.

(21) Appl. No.: 13/804,644

(22) Filed: Mar. 14, 2013

(51) Int. Cl.

| | |
|---|---|
| ***F41A 3/00*** | (2006.01) |
| ***F41A 35/00*** | (2006.01) |
| ***F41C 27/00*** | (2006.01) |
| ***F41A 3/66*** | (2006.01) |

(52) U.S. Cl.
CPC ..... *F41A 3/66* (2013.01)
USPC ..... 42/16; 89/30

(58) Field of Classification Search
USPC ..... 42/16–22, 16.1, 71.01, 72, 74, 106, 42/112; 89/1.4, 30, 26
See application file for complete search history.

(56) References Cited

U.S. PATENT DOCUMENTS

| | | | | |
|---|---|---|---|---|
| 35,019 | A * | 4/1862 | Gould | 89/30 |
| 95,720 | A * | 10/1869 | Pearson | 89/30 |
| 2,951,424 | A * | 9/1960 | Stoner | 89/179 |
| 4,102,242 | A * | 7/1978 | Liedke | 89/191.01 |
| 5,551,179 | A * | 9/1996 | Young | 42/16 |
| 7,444,775 | B1 * | 11/2008 | Schuetz | 42/76.01 |
| 8,316,756 | B1 * | 11/2012 | Woodell et al. | 89/193 |
| 2011/0226120 | A1 * | 9/2011 | Fitzpatrick et al. | 89/1.4 |
| 2011/0252957 | A1 * | 10/2011 | Overstreet et al. | 89/128 |
| 2012/0174451 | A1 * | 7/2012 | Overstreet et al. | 42/16 |
| 2013/0092014 | A1 * | 4/2013 | Kincel | 89/1.4 |

OTHER PUBLICATIONS http://www.precisionreflex.com/Detail.aspx?PROD=186694, Mar. 14, 2013.
http://www.simplisticshootingsolutions.com/Products.php, Mar. 14, 2013.

* cited by examiner

*Primary Examiner* — Bret Hayes
(74) *Attorney, Agent, or Firm* — Shaddock Law Group, PC

(57) ABSTRACT

An pressure reducing component for a firearm that includes one or more vent apertures formed through a side wall or the forward assist cover of an upper receiver. The vent aperture(s) may be completely open to allow gases to be vented from within the upper receiver or may be adjusted to allow a desired amount of gas to be vented from within the upper receiver.

9 Claims, 14 Drawing Sheets

VENTED UPPER RECEIVER FOR A FIREARM

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING

Compact Disc Appendix

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE INVENTION

1. Field of the Invention

The present disclosure relates generally to the field of firearms. More specifically, the present invention relates to an upper receiver for a firearm that reduces or eliminates unwanted back pressure within the cavity of the upper receiver.

2. Description of Related Art

Various firearms operate based on a gas blowback system. One such firearm is the M-16, M-4, and AR-15 family of firearms.

The AR-15 is based on the AR-10, which was designed by Eugene Stoner, Robert Fremont, and L. James Sullivan of the Fairchild ArmaLite corporation in 1957. Today, there are numerous variants of the AR-15 that are manufactured by a number of companies. The AR-15 and its various related derivative platforms are used by civilians, law enforcement personnel, and military forces around the world.

During normal operation of a semiautomatic AR-15 style rifle, when a round is fired, gas from the burning propellant forces the bullet through the barrel. Before the bullet leaves the barrel, a portion of the gas enters a gas port in the upper part of the barrel under the front sight (or gas block). The gas port directs gas through a portion of the front sight (or gas block) and into the gas tube, which directs the gas into a cylinder between the bolt carrier and the bolt and drives the bolt carrier rearward.

The buffer, which is pushing on the rear of the bolt carrier group, is forced rearward by the bolt carrier group compressing the recoil spring. During this rearward movement, a cam track in the upper portion of the bolt carrier acts on the bolt cam pin, rotating the cam pin and bolt clockwise so that the bolt locking lugs are unlocked from the barrel extension locking lugs. As the rearward movement of the bolt carrier group continues, the empty cartridge case is extracted from the chamber, and ejected through the ejection port.

As the bolt carrier group clears the top of an inserted magazine and the empty cartridge case is expelled, a new round is pushed into the path of the bolt by the upward thrust of the magazine follower and spring.

As the bolt carrier group continues to move rearward, it overrides the hammer and forces the hammer down into the receiver, compressing the hammer spring, and allowing the rear hook of the hammer to engage with the hammer disconnect.

When the bolt carrier group reaches its rearmost position (when the rear of the buffer contacts the rear of the buffer tube), the compressed recoil spring expands, driving the buffer assembly forward with enough force to drive the bolt carrier group forward, toward the chamber, initiating chambering of the waiting round from the magazine into the chamber.

The forward movement of the bolt ceases when the locking lugs pass between the barrel extension locking lugs and the round is fully chambered. When the bolt carrier enters the final portion of its forward movement, the bolt cam pin emerges from the cam pin guide channel in the upper receiver and moves along the cam track, rotating the bolt counterclockwise. This rotation locks the bolt to the barrel extension (by interaction of the bolt locking lugs and the barrel extension locking lugs). The locking of the bolt completes the cycle of operation and, when the trigger is released, the rear hammer hook hammer slips from the disconnect and the front hammer hook is caught by the sear of the trigger. The firearm is then ready to be fired again.

Unfortunately, as this cycle occurs, gas pressure (back pressure) builds within the cavity of the upper receiver. This is particularly true if a suppressor is used in conjunction with the firearm. Typically, this back pressure escapes from the receiver through the charging handle aperture. This can cause hot exhaust gases, unburned powder, and lubricants to be blown into a user's face, damaging the user's eyes and potentially causing temporary or permanent blindness.

One common way to combat this problem is to use a specialized charging handle that directs the escaping gases away from the user's face. In some instances, users attempt to use a stronger recoil spring and/or or a heavier buffer or shorten the firearm's gas system.

Any discussion of devices, documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE INVENTION

Unfortunately, these known attempts to remedy the problem of back pressure building within the cavity of the upper receiver do not provide an effective or efficient solution. Specialized charging handles only direct the exhaust gases to one side (right side) and can still be problematic if the user is left-handed, because the exhaust gases will be directed into the user's face. Some of these makeshift solutions can, in fact, introduce more problems into the firearm platform and negatively affect reliability.

Thus, the various embodiments of the present invention relate to an upper receiver for a firearm with features that reduce or eliminate unwanted back pressure within the cavity of the upper receiver.

In various exemplary, non-limiting embodiments, the pressure reducing upper receiver of the present invention includes an upper receiver having a forward assist aperture and a forward assist cover. At least one vent aperture is formed through the forward assist cover so as to allow gases to escape from the interior of the upper receiver. In certain exemplary embodiments, multiple vent apertures are formed through the forward assist cover.

The vent aperture(s) can be formed anywhere along the forward assist cover for either side wall of the upper receiver. Preferably, the events are positioned so that vented exhaust gases escape from the vent aperture(s) and away from a user's face. The vent aperture(s) may be angled forward so that the exhaust gases are vented forward and further away from the user's face.

In certain embodiments, a cover element is pivotably attached or coupled to the forward assist cover and is pivotable between an open position and a closed position. The cover element can be pivotably attached or coupled to the upper receiver above the vent aperture(s) or below the vent aperture(s). When the cover element is in the open position, gases are allowed to escape from the vent aperture(s). However, when the cover element is in the closed position, the cover element occludes (or at least partially occludes) vent aperture(s) so that gases cannot escape from the vent aperture(s) or at least only a portion of gas is allowed to escape from the vent aperture(s).

In various exemplary, nonlimiting embodiments, a rotatable adjuster is positioned within the forward assist aperture. The rotatable adjuster allows the effective size of the vent aperture(s) to be adjusted by rotation of the rotatable adjuster.

According to other exemplary aspects of the present invention, the pressure reducing upper receiver includes one or more vent aperture(s) formed through at least one of the opposing side walls of the upper receiver, within a charging handle receiving portion of the upper receiver.

In certain exemplary, nonlimiting embodiments, the pressure reducing upper receiver includes at least one vent aperture formed through at least one of the opposing side walls and an adjustable gas relief valve is positioned within the at least one vent aperture. The adjustable gas relief valve may be a spring-loaded gas relief valve, an adjustable gas relief valve, an offset rod having a thumbwheel adjustment portion, or a tapered rod having a thumbwheel adjustment portion.

Accordingly, the presently disclosed invention provides a vented upper receiver that allows the pressure within the cavity of the upper receiver to be regulated.

The presently disclosed invention separately provides a vented upper receiver that optionally allows back pressure to be directed out of the internal cavity of the upper receiver.

The presently disclosed invention separately provides a vented upper receiver that optionally allows a user to control how much exhaust gas is vented from the upper receiver and thereby adjust the amount of back pressure to be directed out of the internal cavity of the upper receiver.

The presently disclosed invention separately provides a vented forward assist that maintains operability of the forward assist.

The presently disclosed invention separately provides a vented upper receiver with vent aperture(s) that can optionally be closed or covered to keep dirt and debris out of the upper receiver.

The presently disclosed invention separately provides a vented upper receiver that can be easily manipulated by a user.

These and other features and advantages of the presently disclosed upper receiver are described in or are apparent from the following detailed description of the exemplary, non-limiting embodiments.

BRIEF DESCRIPTION OF THE SEVERAL VIEWS OF THE DRAWINGS

As required, detailed embodiments of the present invention are disclosed herein. However, it is to be understood that the disclosed embodiments are merely exemplary of the invention that may be embodied in various and alternative forms. The figures are not necessarily to scale and some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present invention.

The exemplary embodiments of this invention will be described in detail, with reference to the following figures, wherein like reference numerals refer to like parts throughout the several views, and wherein.

DETAILED DESCRIPTION OF THE INVENTION

For simplicity and clarification, the design factors and operating principles of the upper receiver according to this invention are explained with reference to various exemplary embodiments of a vented upper receiver according to this invention. The basic explanation of the design factors and operating principles of the upper receiver is applicable for the understanding, design, and operation of the vented upper receiver of this invention. It should be appreciated that the upper receiver can be adapted to many applications where excessive gas pressure or blowback is experienced within a firearm.

It should also be appreciated that the terms "AR-15", "firearm", and "upper receiver" are used for basic explanation and understanding of the operation of the systems, methods, and apparatuses of this invention. Therefore, the terms "AR-15", "firearm", and "upper receiver" are not to be construed as limiting the systems, methods, and apparatuses of this invention. Thus, the terms "AR-15" and "firearm" are to be understood to broadly include any firearm having a blowback operated system.

Throughout this application the word "comprise", or variations such as "comprises" or "comprising" are used. It will be understood that these terms are meant to imply the inclusion of a stated element, integer, step, or group of elements, integers, or steps, but not the exclusion of any other element, integer, step, or group of elements, integers, or steps.

Figure 1A:
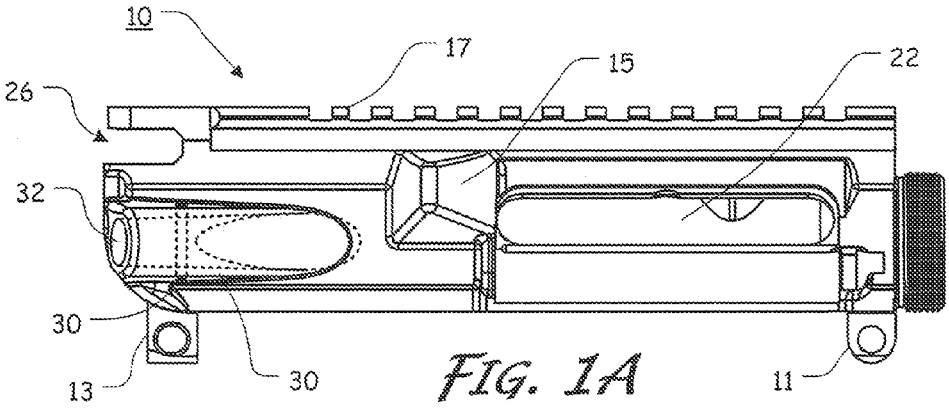
FIG. 1A PRIOR ART
FIG. 1A shows a side view of an AR-15 style upper receiver.
Figure 1B:
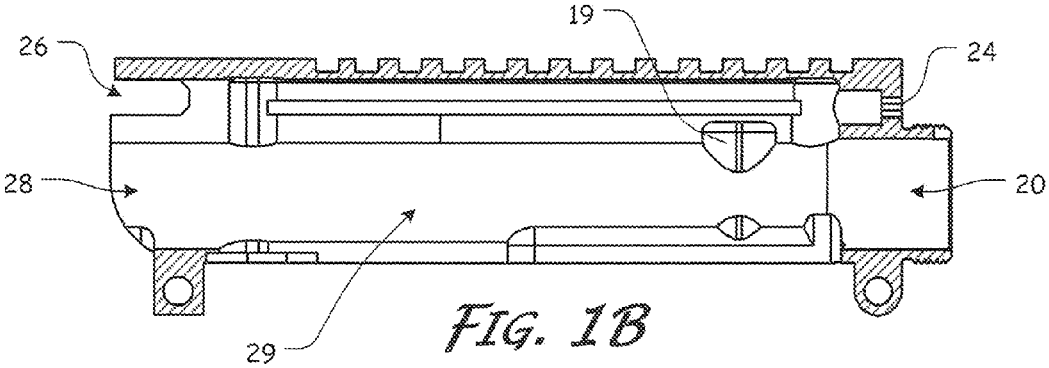
FIG. 1B PRIOR ART
FIG. 1B shows a side cutaway view of an AR-15 style upper receiver.
Figure 1C:
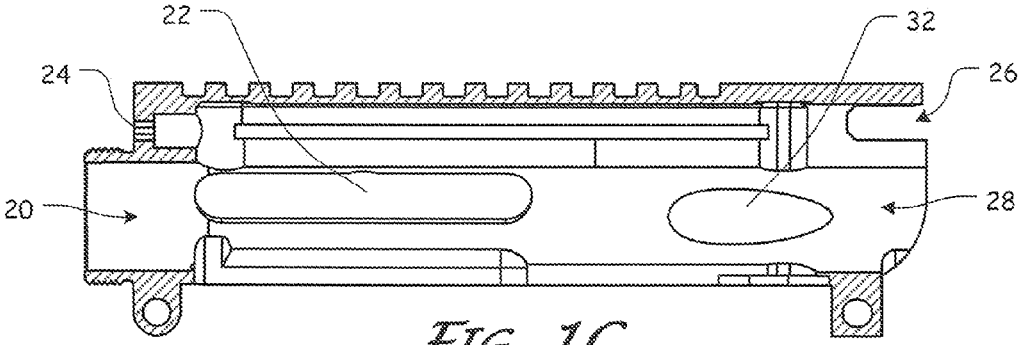
FIG. 1C PRIOR ART
FIG. 1C shows a side cutaway view of an AR-15 style upper receiver.
Figure 2:
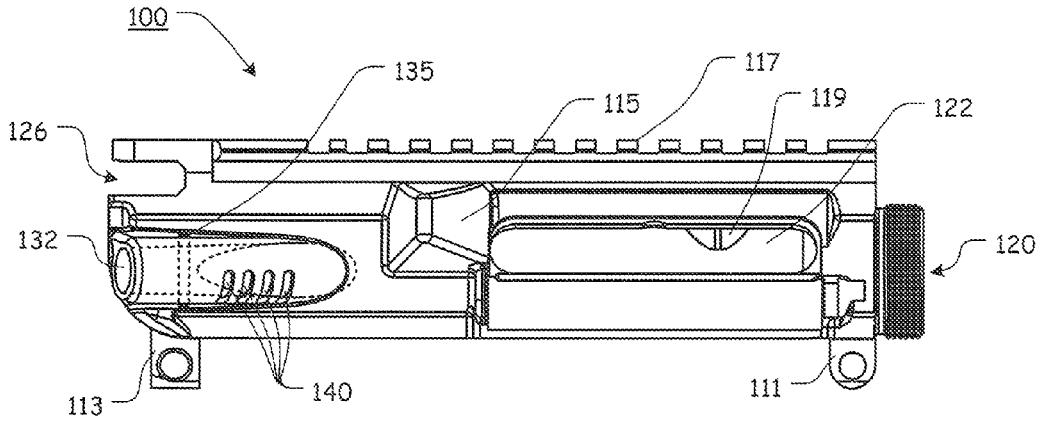
FIG. 2 shows a right side view of a first exemplary embodiment of a vented upper receiver, according to this invention.
Figure 3:
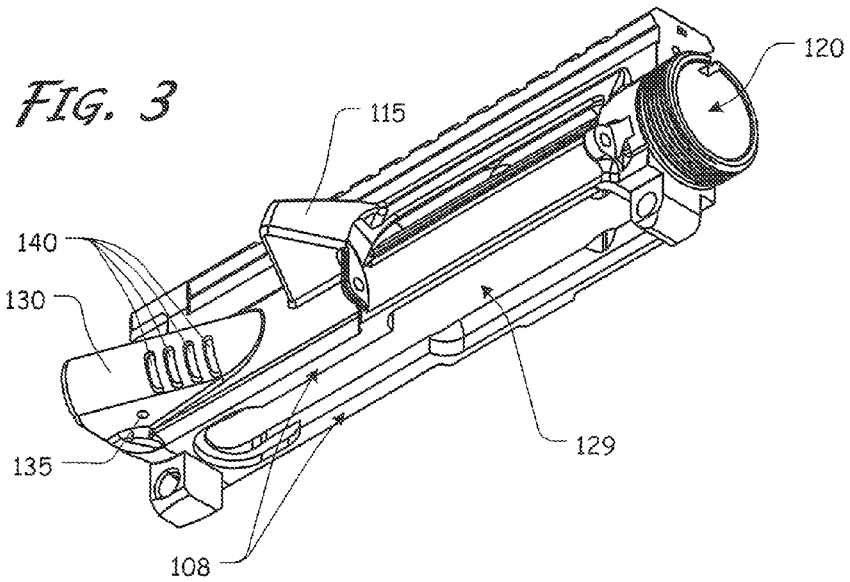
FIG. 3 shows a front, lower perspective view of a first exemplary embodiment of a vented upper receiver, according to this invention.
Figure 4:
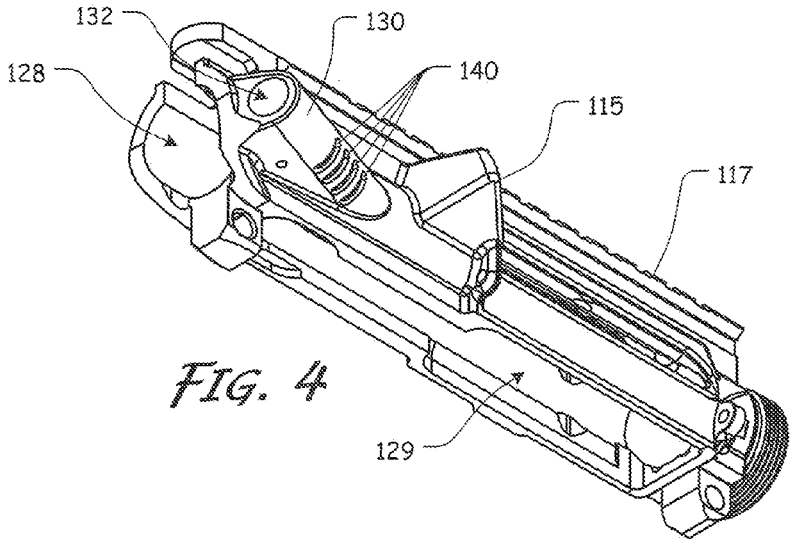
FIG. 4 shows a rear, lower perspective view of a first exemplary embodiment of a vented upper receiver, according to this invention.
Figure 5:
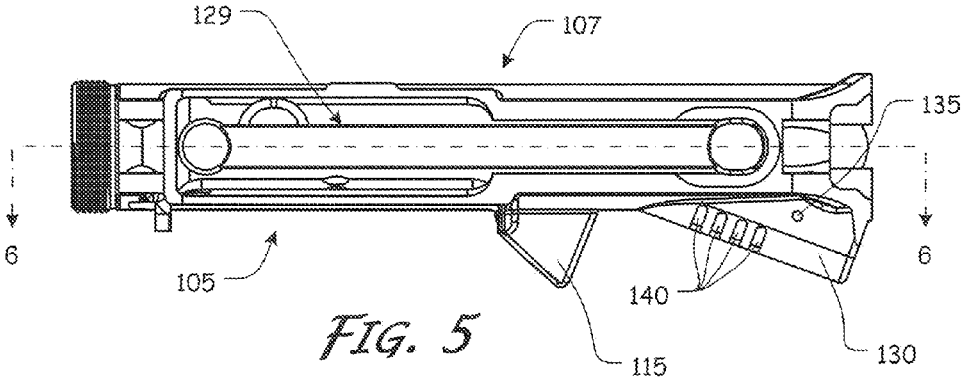
FIG. 5 shows a bottom view of a first exemplary embodiment of a vented upper receiver, according to this invention.
Figure 6:
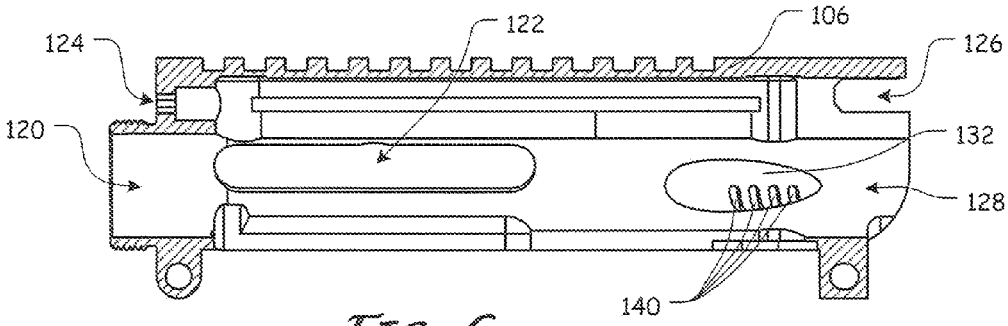
FIG. 6 shows a cross-sectional view taken along line 6-6 of the vented upper receiver of FIG. 5.

Turning now to the drawing Figs., FIGS. 1A-1C illustrate certain elements and/or aspects of a known, exemplary AR-15 upper receiver 10.

Generally, the upper receiver 10 includes a right side wall, a top wall, a left side wall, and a bottom wall. It should be appreciated that, depending upon the desired configuration of the upper receiver 10, the right side wall and the left side wall can be alternated so that the left side wall becomes the right side wall and the right side wall becomes the left side wall.

An upper receiver cavity 29 is defined within the walls of the upper receiver 10. The cavity 29 generally extends from a charging handle aperture 26 and a bolt aperture 28 to a gas tube aperture 24 and a barrel aperture 20. The charging handle aperture 26 is generally aligned along a longitudinal axis of the upper receiver 10 with the gas tube aperture 24. Likewise, the bolt aperture 28 is generally aligned along the longitudinal axis of the upper receiver 10 with the barrel aperture 20.

A cam pin guide channel 19 is formed in an interior surface of the left side wall, while an ejection port aperture 22 and a forward assist aperture 32 are formed through the right side wall of the upper receiver 10.

The forward assist aperture 32 extends from the right side wall and is defined by a forward assist cover 30. A forward assist roll pin aperture 35 is formed through at least a portion of the forward assist cover 30.

A shell deflector 15 is optionally formed on the exterior of the right side wall and, depending upon the configuration, a carry handle (not shown) or a picatinny rail portion 17 is formed along the exterior of the top wall.

A pivot pin lug 11 and a take-down pin lug 13 extend from the bottom wall of the upper receiver 10 and allow the upper receiver 10 to be secured to an appropriate lower receiver.

It should also be appreciated that a more detailed explanation of the components of the upper receiver 10, instructions regarding how to attach and use the various components of the upper receiver 10, methods for installing the related components of the upper receiver 10, and certain other items and/or techniques necessary for the implementation and/or operation of the various components of the AR-15 platform are not provided herein because such components are commercially available and/or such background information will be known to one of ordinary skill in the art. Therefore, it is believed that the level of description provided herein is sufficient to enable one of ordinary skill in the art to understand and practice the systems, methods, and/or apparatuses as described.

FIGS. 2-6 illustrate certain elements and/or aspects of an exemplary embodiment of a pressure reducing, vented upper receiver 100, according to this invention. In certain illustrative, non-limiting embodiments of this invention, as illustrated in FIGS. 2-6, the vented upper receiver 100 comprises at least some of a right side wall 105, a top wall 106, a left side wall 107, a bottom wall 108, a pivot pin lug 111, and a take-down pin lug 113. An upper receiver cavity 129 is defined within the walls of the vented upper receiver 100. The cavity 129 generally extends from a charging handle aperture 126 and a bolt aperture 128 to a gas tube aperture 124 and a barrel aperture 120. The charging handle aperture 126 is generally aligned along a longitudinal axis of the vented upper receiver 100 with the gas tube aperture 124. Likewise, the bolt aperture 128 is generally aligned along the longitudinal axis of the vented upper receiver 100 with the barrel aperture 120.

A cam pin guide channel 119 is formed in an interior surface of the left side wall 107, while an ejection port aperture 122 and a forward assist aperture 132 are formed through the right side wall 105 of the vented upper receiver 100.

The forward assist aperture 132 extends from the right side wall 105 and is defined by a forward assist cover 130. A forward assist roll pin aperture 135 is formed through at least a portion of the forward assist cover 130.

A shell deflector 115 is optionally formed on the exterior of the right side wall 105 and, depending upon the configuration, a carry handle (not shown) or a picatinny rail portion 117 is formed along the exterior of the top wall 106.

It should be understood that each of these elements corresponds to and operates similarly to the right side wall, the top wall, the left side wall, the bottom wall, the pivot pin lug 11, the take-down pin lug 13, the shell deflector 15, the picatinny rail portion 17, the cam pin guide channel 19, the barrel aperture 20, the ejection port aperture 22, the gas tube aperture 24, the charging handle aperture 26, the bolt aperture 28, the upper receiver cavity 29, the forward assist cover 30, the forward assist aperture 32, and the forward assist roll pin aperture 35, as described above with reference to the upper receiver 10 of FIGS. 1A-1C.

However, as illustrated in FIGS. 2-6, the vented upper receiver 100 includes at least one vent aperture 140 formed through the forward assist cover 130. The at least one vent aperture 140 is formed so as to allow fluid communication between the upper receiver cavity 129, via a portion of the forward assist aperture 132, and the environment outside the vented upper receiver 100, thereby allowing gases to escape from the upper receiver cavity 129. In certain exemplary embodiments, as illustrated, multiple vent apertures 140 are formed through the forward assist cover 130.

In certain exemplary embodiments, as illustrated, the at least one vent aperture 140 is formed proximate a bottom portion of the forward assist cover 130. In this manner, vented gases that escape through the at least one vent aperture 140 are directed away from a user's face. However, it should be appreciated that the vent aperture(s) 140 can be formed anywhere along the forward assist cover 130. Furthermore, it should be appreciated that the vent aperture(s) can be formed anywhere along the right side wall 105 or left side wall 107 and may or may not be located on the forward assist cover 130.

In certain embodiments, a screen or mesh material may optionally be placed within or on either side of the vent aperture(s) 140. The screen or mesh material, if included can help to reduce the amount of material that can enter or exit the forward assist aperture 132 and/or the upper receiver cavity 129, via the vent aperture(s) 140.

Figure 7:
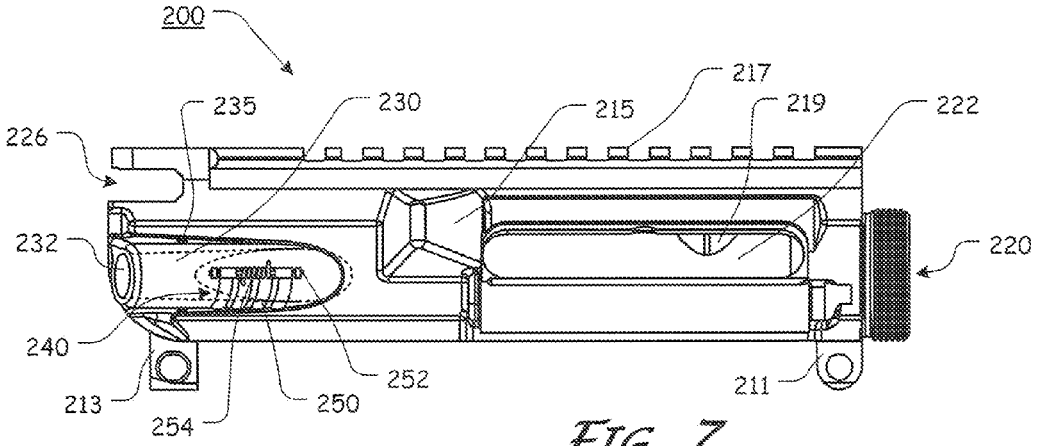
FIG. 7 shows a right side view of a second exemplary embodiment of a vented upper receiver, according to this invention.

FIG. 7 illustrates certain elements and/or aspects of an exemplary embodiment of a pressure reducing, vented upper receiver 200, according to this invention. As illustrated in FIG. 7, the vented upper receiver 200 comprises at least some of a right side wall 205 (not labeled), a top wall 206 (not labeled), a left side wall 207 (not labeled), a bottom wall 208 (not labeled), a pivot pin lug 211, a take-down pin lug 213, an optional shell deflector 215, a cam pin guide channel 219, a barrel aperture 220, an ejection port aperture 222, a gas tube aperture 224 (not shown), a charging handle aperture 226, a bolt aperture 228 (not labeled), an upper receiver cavity 229 (not labeled), a forward assist cover 230, a forward assist aperture 232, a forward assist roll pin aperture 235, and at least one vent aperture 240.

It should be understood that each of these elements corresponds to and operates similarly to the right side wall 105, the top wall 106, the left side wall 107, the bottom wall 108, the pivot pin lug 111, the take-down pin lug 113, the optional shell deflector 115, the cam pin guide channel 119, the barrel aperture 120, the ejection port aperture 122, the gas tube aperture 124, the charging handle aperture 126, the bolt aperture 128, the upper receiver cavity 129, the forward assist cover 130, the forward assist aperture 132, the forward assist roll pin aperture 135, and the vent aperture(s) 140, as described above with reference to the vented upper receiver 100 of FIGS. 2-6.

However, as illustrated in FIG. 7, a cover element 250 is pivotably attached or coupled to the forward assist cover 230. The cover element 250 is shaped and sized so as to be able to be placed over and occlude the vent aperture(s) 240. While the cover element 250 is illustrated as having multiple extensions or fingers, it should be understood that the cover element 250 may include multiple extensions or may comprise a singular door.

The cover element 250 is pivotably attached or coupled to the vented upper receiver 200, via a pivot pin 252, above the vent aperture(s) 140. This enables the cover element 250 to be pivotable between an open position and a closed position (as shown in FIG. 7). When the cover element 250 is in the open position, gases are allowed to escape from the vent aperture(s) 240. However, when the cover element 250 is in the closed position, the cover element 250 occludes the vent aperture(s) 240 so that gases cannot escape from the vent aperture(s) 240.

In various exemplary embodiments, a spring biasing element 254 is optionally included. If included, the spring biasing element 254 causes the cover element 250 to be spring biased to the closed position. Depending upon the strength of the spring biasing element 254, if pressure within the upper receiver cavity 229 reach a sufficient amount, the spring bias of the spring biasing element 254 can be overcome and the cover element 250 can be at least partially pivoted from the closed position to allow excess pressurized gas to be vented from the upper receiver cavity 229. Once the pressure within the upper receiver cavity 229 is no longer sufficient to overcome the spring bias of the spring biasing element 254, the spring biasing element 254 urges the cover element 250 back to the closed position.

Figure 8:
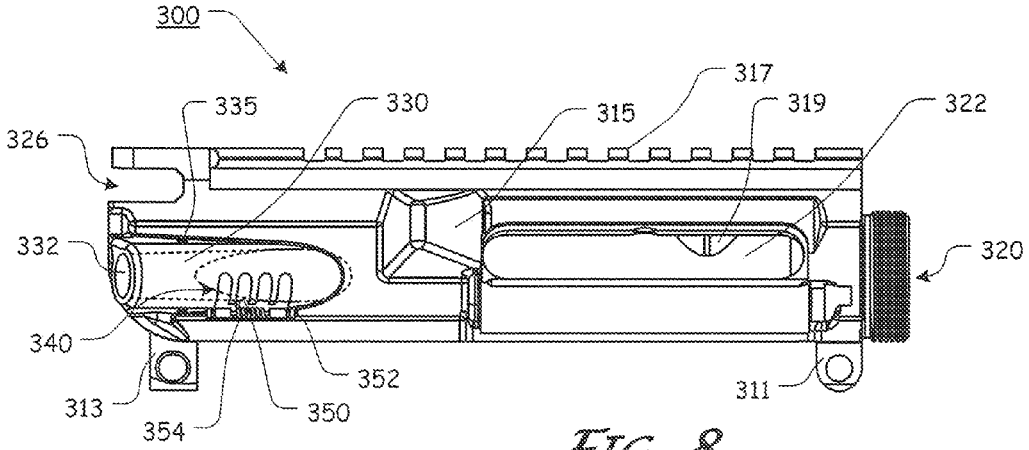
FIG. 8 shows a right side view of a third exemplary embodiment of a vented upper receiver, according to this invention.
Figure 9:
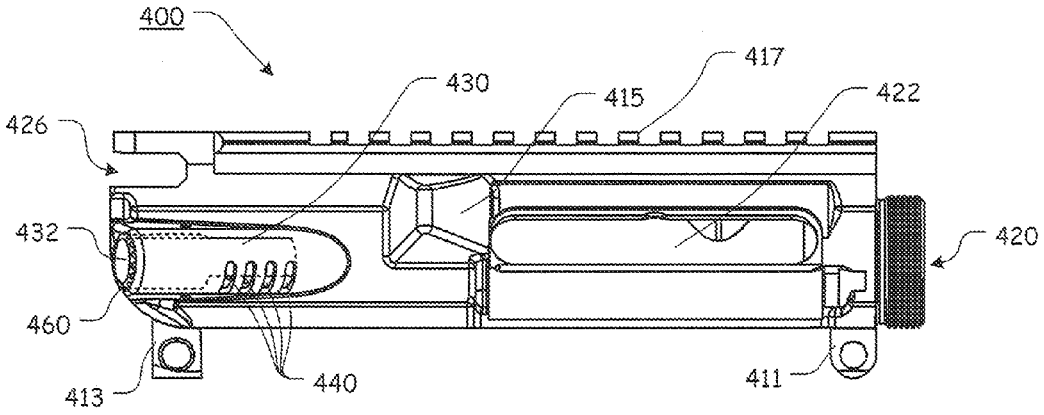
FIG. 9 shows a right side view of a fourth exemplary embodiment of a vented upper receiver, according to this invention.
Figure 10:
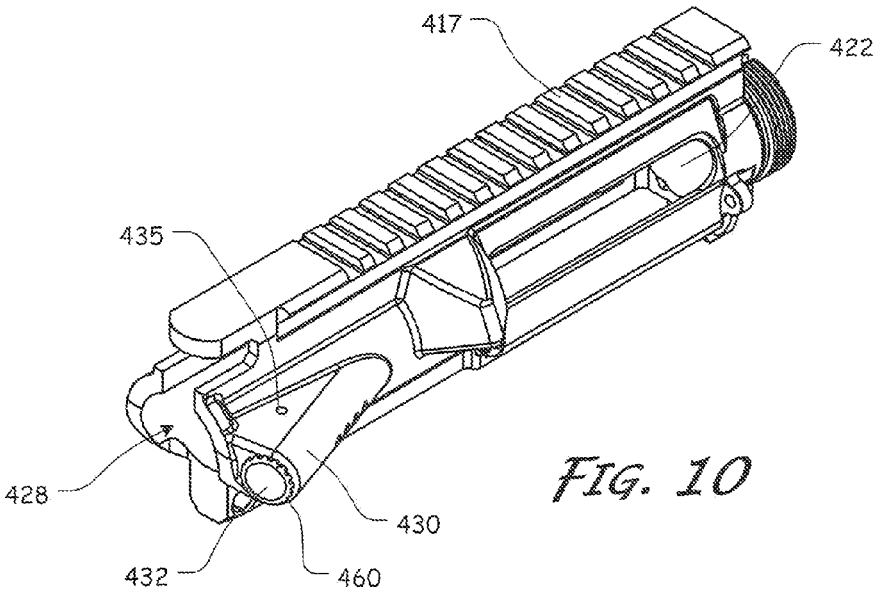
FIG. 10 shows a rear, upper perspective view of the fourth exemplary embodiment of a vented upper receiver, according to this invention.
Figure 11:
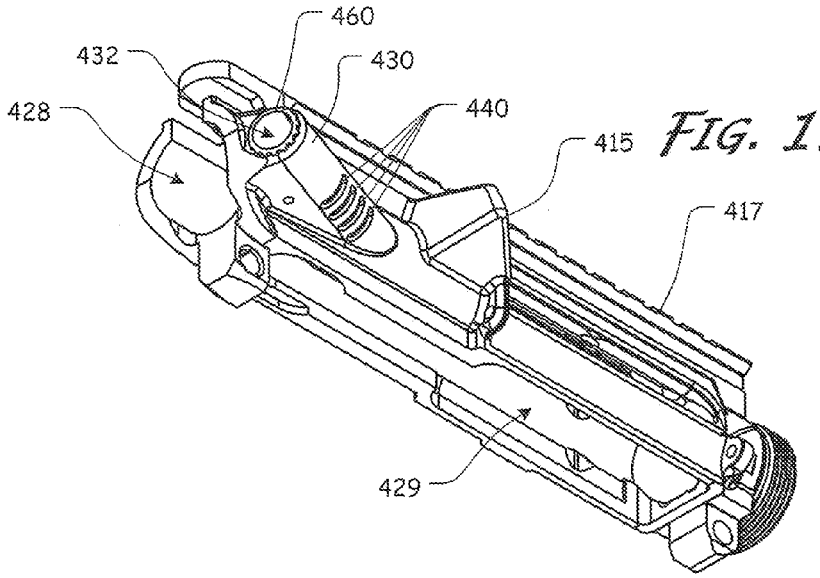
FIG. 11 shows a rear, lower perspective view of the fourth exemplary embodiment of a vented upper receiver, according to this invention.

FIG. 8 illustrates certain elements and/or aspects of an exemplary embodiment of a pressure reducing, vented upper receiver 300, according to this invention. As illustrated in FIG. 8, the vented upper receiver 300 comprises at least some of a right side wall 305 (not labeled), a top wall 306 (not labeled), a left side wall 307 (not labeled), a bottom wall 308 (not labeled), a pivot pin lug 311, a take-down pin lug 313, an optional shell deflector 315, a cam pin guide channel 319, a barrel aperture 320, an ejection port aperture 322, a gas tube aperture 324 (not shown), a charging handle aperture 326, a bolt aperture 328 (not labeled), an upper receiver cavity 329 (not labeled), a forward assist cover 330, a forward assist aperture 332, a forward assist roll pin aperture 335, at least one vent aperture 340, a cover element 350, a pivot pin 352, and a spring biasing element 354.

It should be understood that each of these elements corresponds to and operates similarly to the right side wall 205, the top wall 206, the left side wall 207, the bottom wall 208, the pivot pin lug 211, the take-down pin lug 213, the optional shell deflector 215, the cam pin guide channel 219, the barrel aperture 220, the ejection port aperture 222, the gas tube aperture 224, the charging handle aperture 226, the bolt aperture 228, the upper receiver cavity 229, the forward assist cover 230, the forward assist aperture 232, the forward assist roll pin aperture 235, the vent aperture(s) 240, the cover element 250, the pivot pin 252, and the spring biasing element 254, as described above with reference to the vented upper receiver 200 of FIG. 7.

However, as illustrated in FIG. 8, the cover element 350 is pivotably attached or coupled to the vented upper receiver 300, via a pivot pin 352, below the vent aperture(s) 340.

FIGS. 9-13C illustrate certain elements and/or aspects of an exemplary embodiment of a pressure reducing, vented upper receiver 400, according to this invention. In certain illustrative, non-limiting embodiments of this invention, as illustrated in FIGS. 9-13C, the vented upper receiver 400 comprises at least some of a right side wall 405 (not labeled), a top wall 406 (not labeled), a left side wall 407 (not labeled), a bottom wall 408 (not labeled), a pivot pin lug 411, a take-down pin lug 413, an optional shell deflector 415, a cam pin guide channel 419, a barrel aperture 420, an ejection port aperture 422, a gas tube aperture 424 (not shown), a charging handle aperture 426, a bolt aperture 428, an upper receiver cavity 429, a forward assist cover 430, a forward assist aperture 432, a forward assist roll pin aperture 435, and at least one vent aperture 440.

It should be understood that each of these elements corresponds to and operates similarly to the right side wall 105, the top wall 106, the left side wall 107, the bottom wall 108, the pivot pin lug 111, the take-down pin lug 113, the optional shell deflector 115, the cam pin guide channel 119, the barrel aperture 120, the ejection port aperture 122, the gas tube aperture 124, the charging handle aperture 126, the bolt aperture 128, the upper receiver cavity 129, the forward assist cover. 130, the forward assist aperture 132, the forward assist roll pin aperture 135, and the vent aperture(s) 140, as described above with reference to the vented upper receiver 100 of FIGS. 2-6.

However, as illustrated in FIGS. 9-13C, a rotatable adjuster 460 is positioned within the forward assist aperture 432. The forward assist is then positioned within and aperture 463 of the rotatable adjuster 460. The rotatable adjuster 460 allows the effective size of the vent aperture(s) 440 to be adjusted by rotation of the rotatable adjuster 460.

Figure 12A:
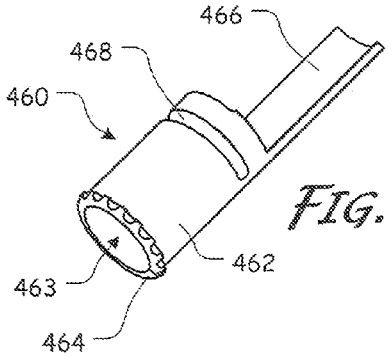
FIG. 12A shows a rear, upper perspective view of an exemplary embodiment of a rotating adjuster, according to this invention.
Figure 12B:
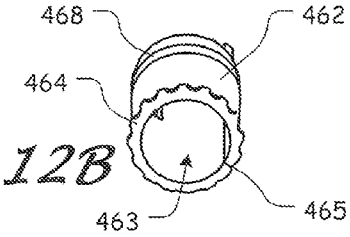
FIG. 12B shows a rear perspective view of an exemplary embodiment of a rotating adjuster, according to this invention.
Figure 12C:
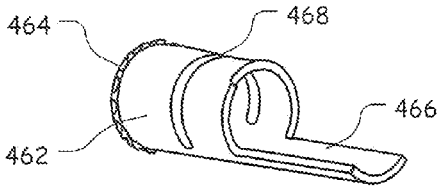
FIG. 12C shows a front perspective view of an exemplary embodiment of a rotating adjuster, according to this invention.

As illustrated most clearly in FIGS. 12A-12C, the rotatable adjuster 460 includes a tubular body portion 462 that extends from a top end to a bottom end. The aperture 463 is formed through the tubular body portion 462. A head portion 464 extends generally outward and upward from the top end of the tubular body portion 462. A surface of the head portion 464 may be textured to provide greater purchase on the head portion 464 of the rotatable adjuster 460. The surface of the head portion 464 may be textured using, for example, stippling, knurling, checkering, annular rings, radial grooves, notches, or other patterns. Providing texture to a surface of the head portion 464 can aid in rotation of the rotatable adjuster 460.

A body extension portion 466 extends from the bottom end of the tubular body portion 462. The body extension portion 466 is sized and shaped so as to be able to occlude at least a desired portion of the vent aperture(s) 440 when the rotatable adjuster 460 is in the closed position and not of occlude the vent aperture(s) 440 when the rotatable adjuster 460 is in the open position.

A position indicator 465 may also be included on the head portion 464. If included, the position indicator 465 gives a tactile and/or visual indicator of the relative position of the body extension portion 466. In this manner, a user can determine the relative rotational position of the rotatable adjuster 460 and determine whether the rotatable adjuster 460 is in the open position, the closed position, or somewhere in between.

The rotatable adjuster 460 also includes at least one roll pin slot 468 formed in the tubular body portion 462. The roll pin slot 468 allow the rotatable adjuster 460 to be maintained within the forward assist aperture 132 by interaction of the roll pin slot 468 with a forward assist roll pin, when the forward assist roll pin is positioned in the forward assist roll pin aperture 435.

It should be understood that the size and shape of the tubular body portion 462 is a design choice based upon the size and shape of the forward assist aperture 432. Likewise, the size and shape of the aperture 463 is a design choice based upon the size and shape of the forward assist that will be used with the rotatable adjuster 460.

In certain embodiments, the forward assist aperture 432 is expanded so as to accept the tubular body portion 462 within the forward assist aperture 432. In this manner, a standard forward assist may optionally be used with the rotatable adjuster 460.

Alternatively, the forward assist aperture 432 may be unchanged and the tubular body portion 462 may be sized so as to fit within a standard forward assist aperture 432. In these instances, a modified forward assist may be necessary to fit within the aperture 463 of the rotatable adjuster 460.

Figure 13A:
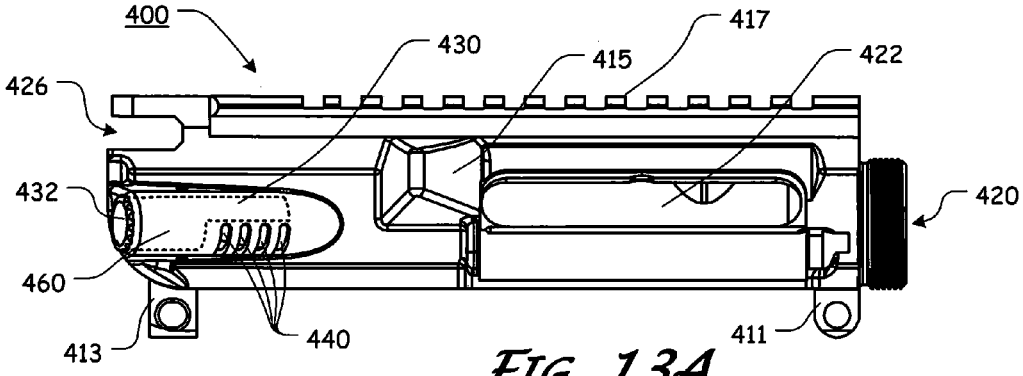
FIG. 13A shows a right side view of the fourth exemplary embodiment of a vented upper receiver, wherein the rotating adjuster is in an open position.
Figure 13B:
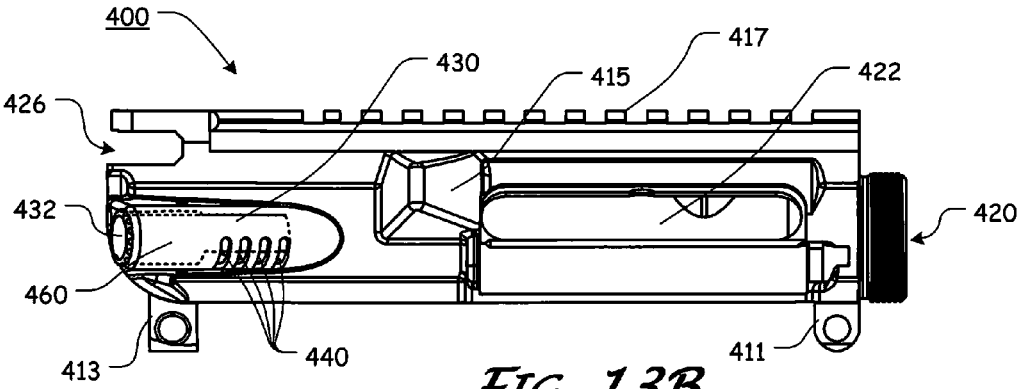
FIG. 13B shows a right side view of the fourth exemplary embodiment of a vented upper receiver, wherein the rotating adjuster is in a partially closed position.
Figure 13C:
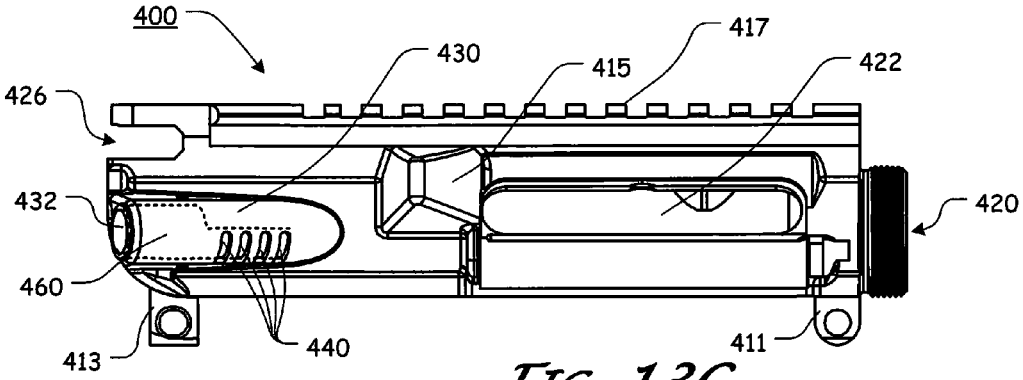
FIG. 13C shows a right side view of the fourth exemplary embodiment of a vented upper receiver, wherein the rotating adjuster is in a closed position.
Figure 14:
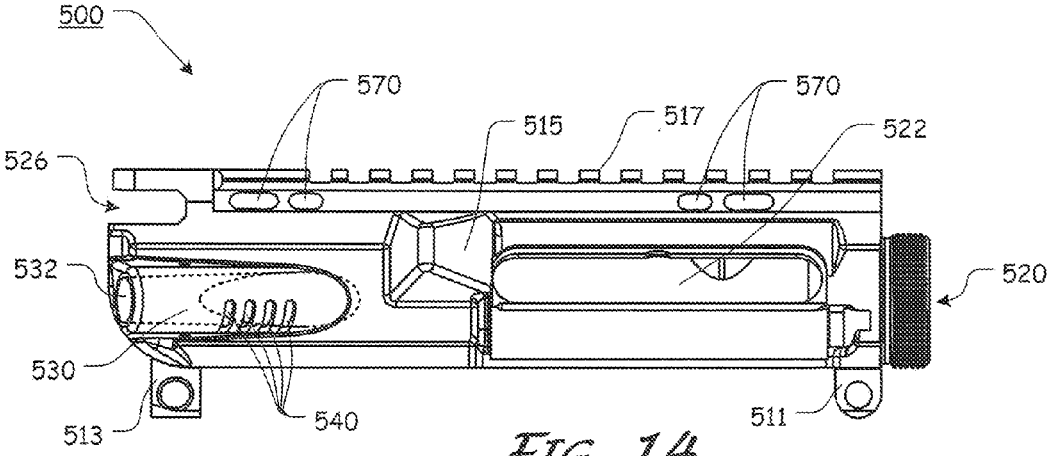
FIG. 14 shows a right side view of a fifth exemplary embodiment of a vented upper receiver, according to this invention.
Figure 15:
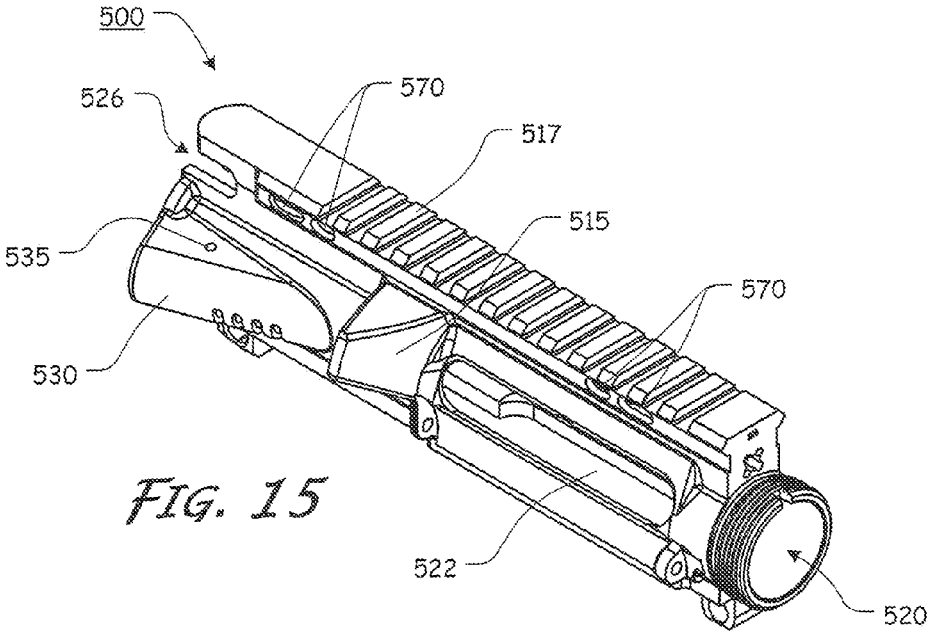
FIG. 15 shows a front, upper perspective view of a fifth exemplary embodiment of a vented upper receiver, according to this invention.
Figure 16:
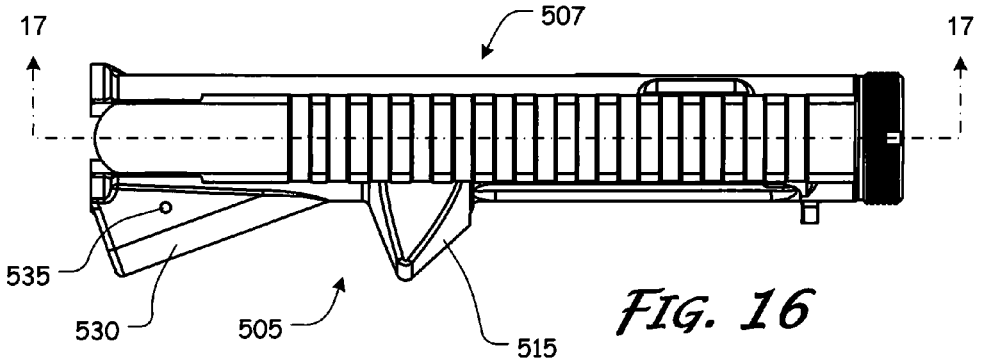
FIG. 16 shows a top view of a fifth exemplary embodiment of a vented upper receiver, according to this invention.

As illustrated in FIGS. 13A-13C, the rotatable adjuster 460 can be positioned in an open position, as illustrated in FIG. 13A. In the open position, the vent aperture(s) 440 are not occluded by the body extension portion 466 and gases are able to flow through the vent aperture(s) 440. When the rotatable adjuster 460 is rotated to the closed position, as illustrated in FIG. 13C, the vent aperture(s) 440 are fully occluded by the body extension portion 466 and gases are unable to flow through the vent aperture(s) 440.

When the rotatable adjuster 460 is rotatable within the forward assist aperture 432 and positioned between the open position and a closed position, as illustrated in FIG. 13A, the vent aperture(s) 440 are selectively, partially occluded by the body extension portion 466. Thus, a user can rotate the rotatable adjuster 462 a desired position that allows a desired amount of gas to flow through the vent aperture(s) 440.

FIGS. 14-19 illustrate certain elements and/or aspects of an exemplary embodiment of a pressure reducing, vented upper receiver 500, according to this invention. In certain illustrative, non-limiting embodiments of this invention, as illustrated in FIGS. 14-19, the vented upper receiver 500 comprises at least some of a right side wall 505, a top wall 506, a left side wall 507, a bottom wall 508, a pivot pin lug 511, a take-down pin lug 513, an optional shell deflector 515, a cam pin guide channel 519, a barrel aperture 520, an ejection port aperture 522, a gas tube aperture 524 (not shown), a charging handle aperture 526, a bolt aperture 528, an upper receiver cavity 529, a forward assist cover 530, a forward assist aperture 532, a forward assist roll pin aperture 535, and optionally at least one vent aperture 540.

It should be understood that each of these elements corresponds to and operates similarly to the right side wall 105, the top wall 106, the left side wall 107, the bottom wall 108, the pivot pin lug 111, the take-down pin lug 113, the optional shell deflector 115, the cam pin guide channel 119, the barrel aperture 120, the ejection port aperture 122, the gas tube aperture 124, the charging handle aperture 126, the bolt aperture 128, the upper receiver cavity 129, the forward assist cover 130, the forward assist aperture 132, the forward assist roll pin aperture 135, and the vent aperture(s) 140, as described above with reference to the vented upper receiver 100 of FIGS. 2-6.

It should also be understood that while the vent aperture(s) 540 are shown as being included in the vented upper receiver 500, the vent aperture(s) 540 may be absent and not included in certain embodiments of the vented upper receiver 500. In such embodiments, only the vent aperture(s) 570 are included in the vented upper receiver 500.

Figure 17:
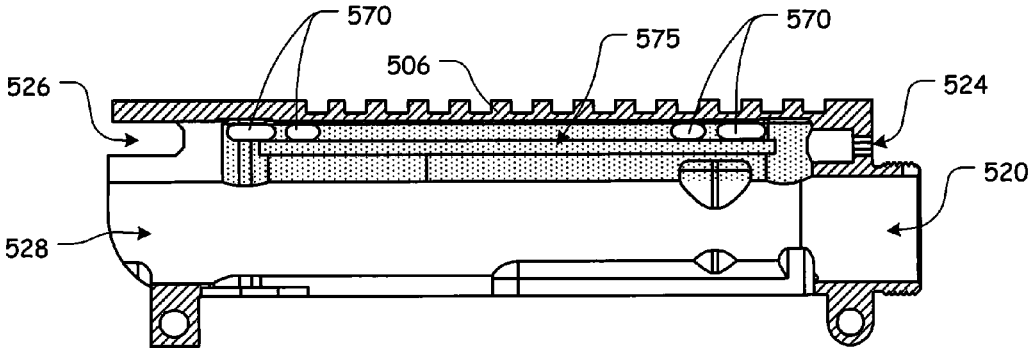
FIG. 17 shows a cross-sectional view taken along line 17-17 of the vented upper receiver of FIG. 16.
Figure 18:
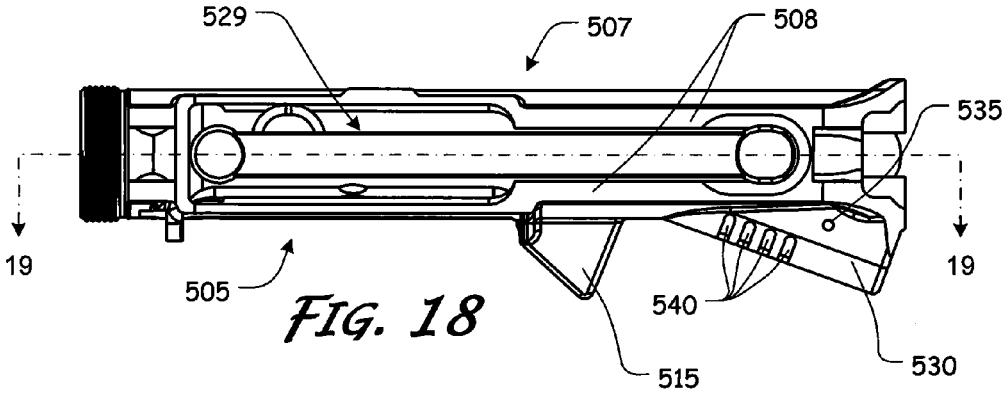
FIG. 18 shows a bottom view of a fifth exemplary embodiment of a vented upper receiver, according to this invention.
Figure 19:
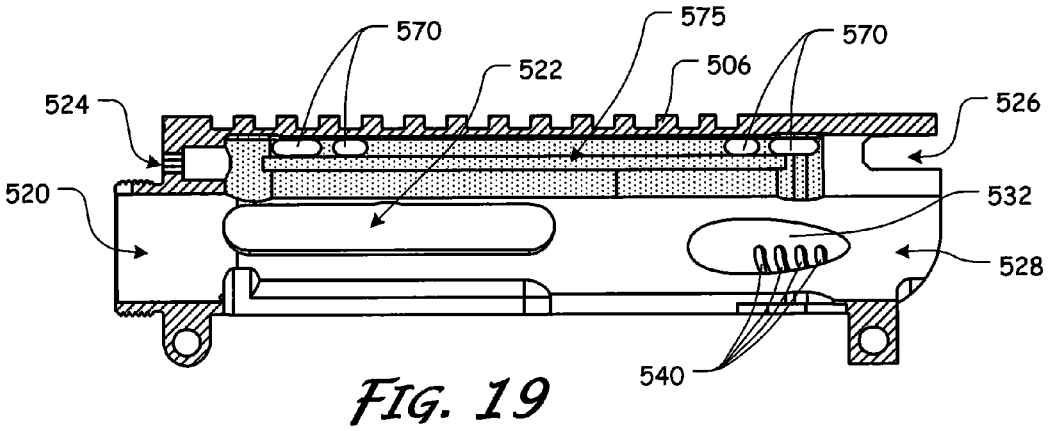
FIG. 19 shows a cross-sectional view taken along line 19-19 of the vented upper receiver of FIG. 18.

As illustrated in FIGS. 14-19, at least one vent aperture 570 is formed through at least one of the right side wall 505 and/or the left side wall 507, within a charging handle receiving portion 575. The charging handle receiving portion, as highlighted in FIGS. 17 and 19, is an area of the vented upper receiver 500, which is shaped to accept a portion of an inserted charging handle.

The size, shape, number, and placement of the vent aperture(s) 570 is a design choice based upon the desired amount of gas that is to be allowed to pass from the upper receiver cavity 529. Therefore, it should be appreciated that the vent aperture(s) 570 may comprise a single aperture on one or each of the side walls 505 and/or 507 or multiple apertures on one or each of the sidewalls 505 and/or 507.

In certain exemplary embodiments, the vent aperture(s) 570 are formed within the charging handle receiving portion 575, between the ejection port aperture 522 and the top wall 506. By placing the vent aperture(s) 570 within the charging handle receiving portion 575, the inserted charging handle would at least partially occluded the vent aperture(s) 570 and keep foreign material from entering into the upper receiver cavity 529 while allowing gas to escape before reaching a user's face.

In certain alternative embodiments, the vent aperture(s) 570 are formed outside of the charging handle receiving portion 575. Thus, it should be appreciated that the vent aperture(s) 570 may be formed in any area of the vented upper receiver 500 in any of the right side wall 505, the top wall 506, and/or the left side wall 507.

Figure 20:
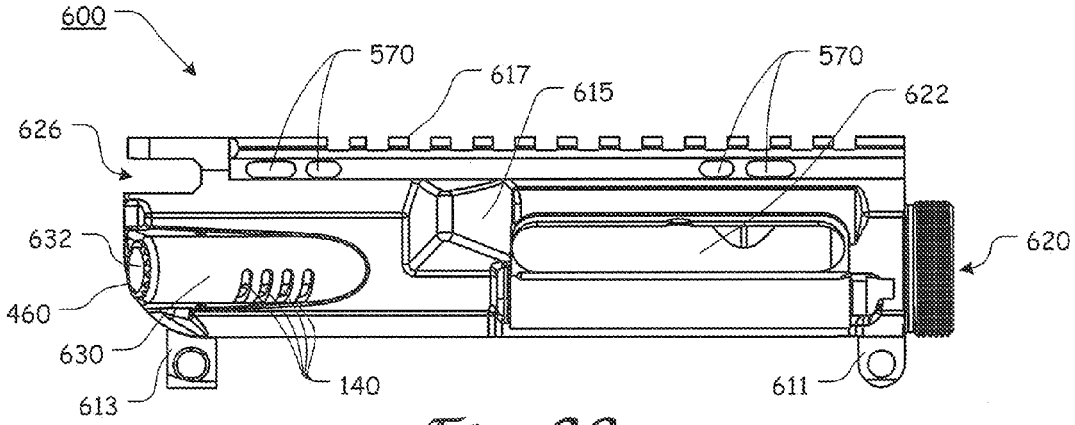
FIG. 20 shows a right side view of a sixth exemplary embodiment of a vented upper receiver, according to this invention.
Figure 21:
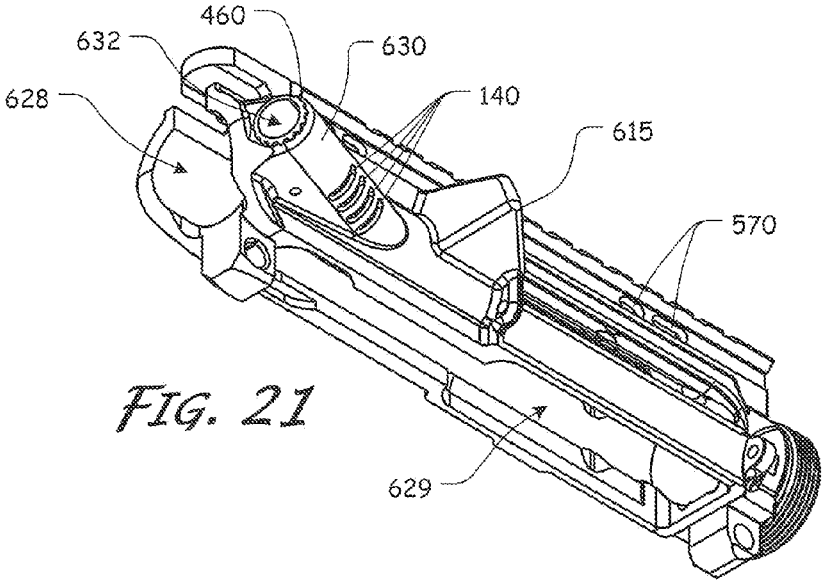
FIG. 21 shows a rear, bottom perspective view of a sixth exemplary embodiment of a vented upper receiver, according to this invention.

FIGS. 20-21 illustrate certain elements and/or aspects of an exemplary embodiment of a pressure reducing, vented upper receiver 600, according to this invention. In certain illustrative, non-limiting embodiments of this invention, as illustrated in FIGS. 20-21, the vented upper receiver 600 incorporates the vent aperture(s) 140, as described above with reference to the vented upper receiver 100 of FIGS. 2-6, the rotatable adjuster 460, as described above with reference to the vented upper receiver 400 of FIGS. 9-13C, and the vent aperture(s) 570, as described above with reference to the vented upper receiver 500 of FIGS. 14-19, into a single vented upper receiver 600.

Figure 22:
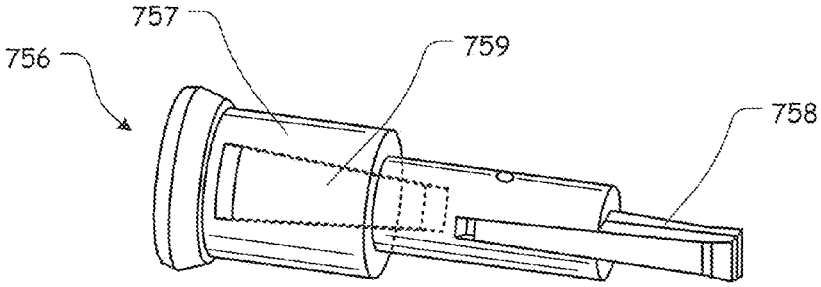
FIG. 22 shows a perspective view of an exemplary embodiment of a vented forward assist, according to this invention.
Figure 23:
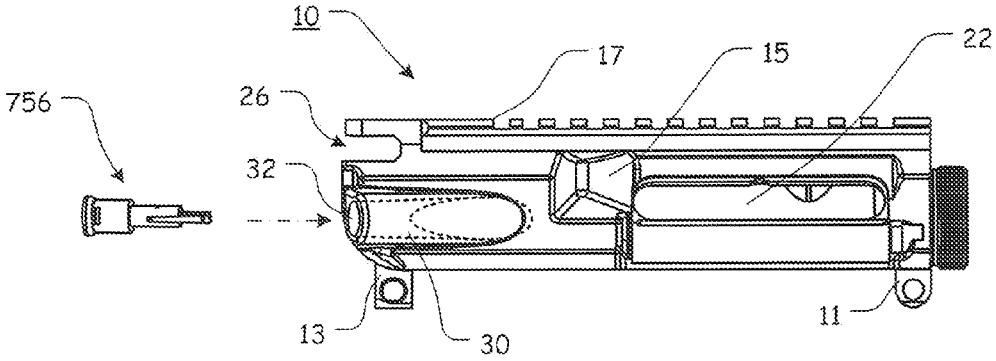
FIG. 23 shows a right side view of a seventh exemplary embodiment of a vented upper receiver, according to this invention.

FIGS. 22-23 illustrate certain elements and/or aspects of an exemplary embodiment of a pressure reducing, vented forward assist 756, according to this invention. As illustrated in FIGS. 22-23, the vented forward assist 756 comprises a forward assist body 757, having a forward assist pawl 758. The forward assist body 757 and forward assist pawl 758 are configured substantially like a standard forward assist. However, the forward assist body 757 includes a channel 759 that extends through opposing sides of the forward assist body 757, such that when the vented forward assist 756 is installed in an upper receiver 10, the channel 759 provides a passageway for gas to be vented from the upper receiver cavity 29, through at least a portion of the forward assist aperture 32, through the channel 759, and into the environment outside the forward assist body 757.

Figure 24:
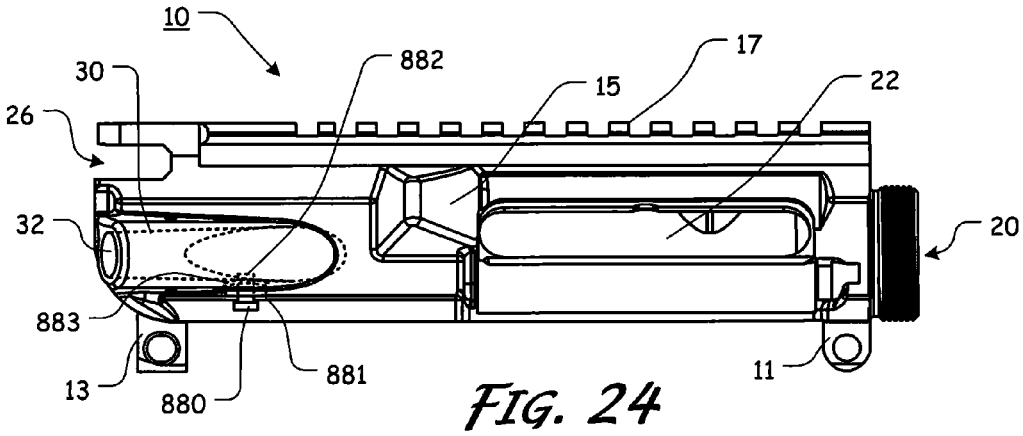
FIG. 24 shows a right side view of a eighth exemplary embodiment of a vented upper receiver, according to this invention.

FIG. 24 illustrates certain elements and/or aspects of an exemplary embodiment of an upper receiver 10 having an adjustable gas relief valve 880, according to this invention. In certain illustrative, non-limiting embodiments of this invention, as illustrated in FIG. 24, the gas relief valve 880 comprises at least some of a housing 881, a pin 882, and a biasing means 883.

In various exemplary embodiments, the gas relief valve 880 is a spring-loaded valve. The gas relief valve 880 allows fluid communication between the upper receiver cavity 29 and, more specifically, the forward assist aperture 32, and the environment outside the upper receiver 10. The housing includes an aperture within which the pin 882 is slidable between an open position and a closed position. The spring biasing means 883 biases the pin 882 to the closed position.

When the bias of the biasing means 883 is overcome, the pin 882 is moved to the open position and gas is permitted to flow from the upper receiver cavity 29.

As illustrated, the housing 881 is attached or coupled to the forward assist cover 30. It should be appreciated, however, that the housing 881 and the gas relief valve 880 may be attached or coupled at any desired position on one of the opposing side walls (105 and 107) of the upper receiver.

Figure 25:
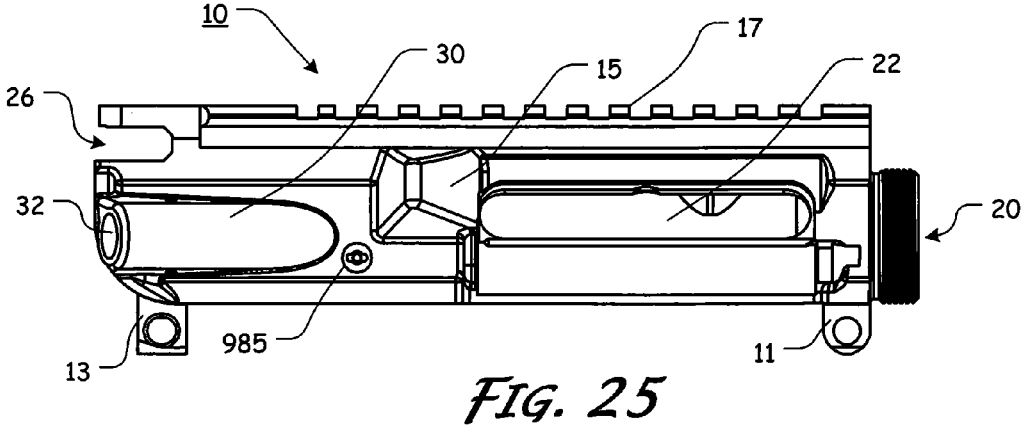
FIG. 25 shows a right side view of a ninth exemplary embodiment of a vented upper receiver, according to this invention.
Figure 26:
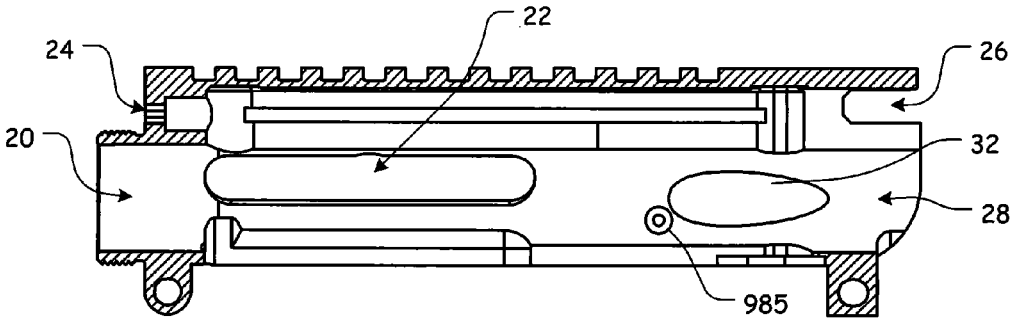
FIG. 26 shows a cross-sectional view of the vented upper receiver of FIG. 25.

FIGS. 25-26 illustrate an alternate embodiment, wherein the upper receiver 10 includes at least one vent aperture formed through at least one of the opposing side walls. The adjustable gas relief valve 985 is positioned within the at least one vent aperture. The adjustable gas relief valve 985 is positioned so as to allow for fluid communication between the upper receiver cavity 29 and the environment outside the upper receiver 10. In certain exemplary embodiments, the gas relief valve 985 may be an adjustable valve, such as, for example, a Schuster type adjustable gas valve/plug.

Figure 27:
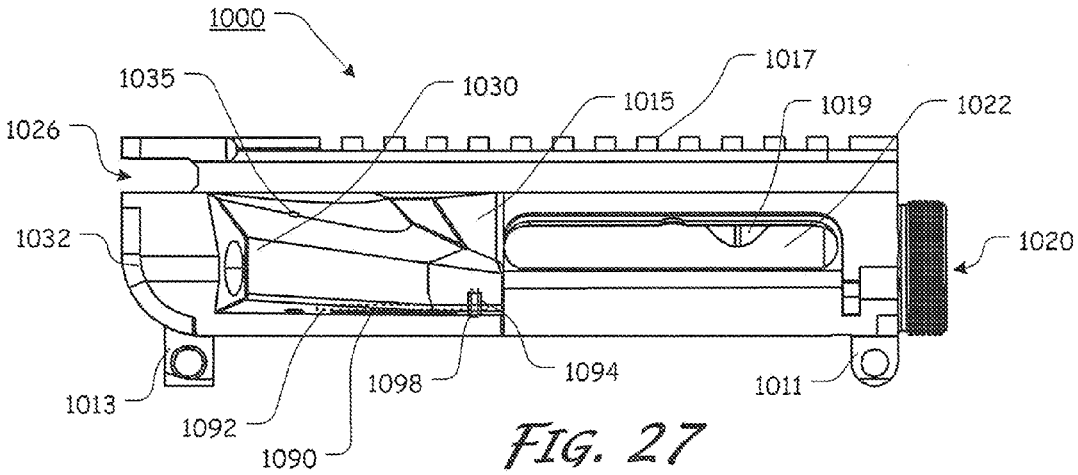
FIG. 27 shows a right side view of a tenth exemplary embodiment of a vented upper receiver, according to this invention.
Figure 28:
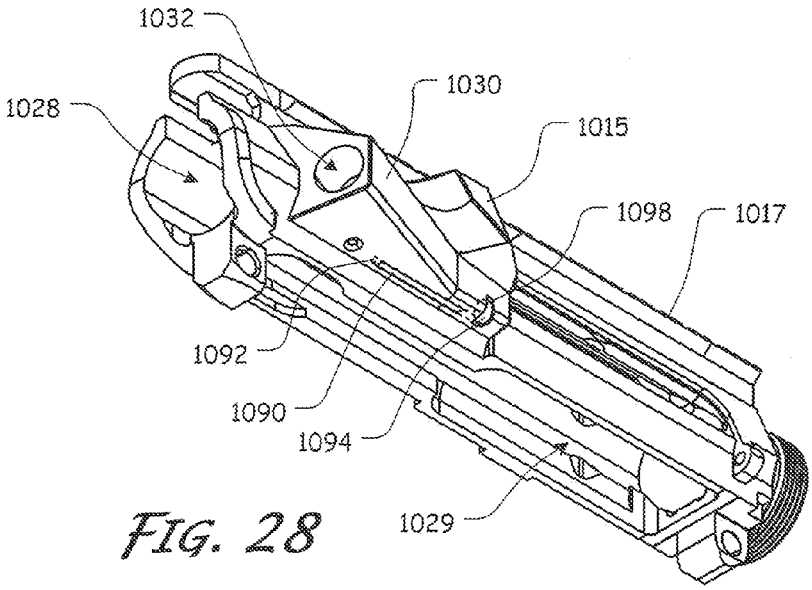
FIG. 28 shows a rear, bottom perspective view of a tenth exemplary embodiment of a vented upper receiver, according to this invention.

FIGS. 27-28 illustrate certain elements and/or aspects of an exemplary embodiment of a pressure reducing, vented upper receiver 1000, according to this invention. In certain illustrative, non-limiting embodiments of this invention, as illustrated in FIGS. 27-28, the vented upper receiver 1000 comprises at least some of a right side wall 1005 (not labeled), a top wall 1006 (not labeled), a left side wall 1007 (not labeled), a bottom wall 1008 (not labeled), a pivot pin lug 1011, a take-down pin lug 1013, an optional shell deflector 1015, a cam pin guide channel 1019, a barrel aperture 1020, an ejection port aperture 1022, a gas tube aperture 1024 (not shown), a charging handle aperture 1026, a bolt aperture 1028, an upper receiver cavity 1029, a forward assist cover 1030, a forward assist aperture 1032, and a forward assist roll pin aperture 1035.

It should be understood that each of these elements corresponds to and operates similarly to the right side wall 105, the top wall 106, the left side wall 107, the bottom wall 108, the pivot pin lug 111, the take-down pin lug 113, the optional shell deflector 115, the cam pin guide channel 119, the barrel aperture 120, the ejection port aperture 122, the gas tube aperture 124, the charging handle aperture 126, the bolt aperture 128, the upper receiver cavity 129, the forward assist cover 130, the forward assist aperture 132, and the forward assist roll pin aperture 135, as described above with reference to the vented upper receiver 100 of FIGS. 2-6.

As illustrated in FIGS. 27-28, the vented upper receiver 1000 also comprises a continuous, elongate aperture 1090 formed through a portion of the forward assist cover 1030. The aperture 1090 forms a channel between the upper receiver cavity 1029 and the exterior of the vented upper receiver 1000. Thus, the upper receiver cavity 1029 is in fluid communication with the exterior of the vented upper receiver 1000, via the aperture 1090.

In order to regulate the flow of gas through the aperture 1090, an offset rod 1092 is positioned within the channel associated with the aperture 1090. A wheel 1094 is positioned within a wheel aperture 1098 and coupled to the rod 1092 such that when the wheel 1094 is rotated, the rod 1092 is also rotated. Because of the offset shape of the rod 1092, as the rod 1092 is rotated, the degree of occlusion of the channel by the rod 1092 is altered. Thus, by rotation of the wheel 1094, the amount of gas that can be expelled through the aperture 1090 can be adjusted.

While this invention has been described in conjunction with the exemplary embodiments outlined above, the foregoing description of exemplary embodiments of the invention, as set forth above, are intended to be illustrative, not limiting and the fundamental invention should not be considered to be necessarily so constrained. It is evident that the invention is not limited to the particular variation set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the invention. The upper and lower limits of these smaller ranges may independently be included in the smaller ranges and is also encompassed within the invention, subject to any specifically excluded limit in the stated range. Where the stated range includes one or both of the limits, ranges excluding either or both of those included limits are also included in the invention.

It is to be understood that the phraseology of terminology employed herein is for the purpose of description and not of limitation. Unless defined otherwise, all technical and scientific terms used herein have the same meaning as commonly understood by one of ordinary skill in the art to which this invention belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the invention, such that others may, by applying current knowledge, change, vary, modify, and/or adapt these exemplary, non-limiting embodiments for various applications without departing from the spirit and scope of the invention and elements or methods similar or equivalent to those described herein can be used in practicing the present invention. Any and all such changes, variations, modifications, and/or adaptations should and are intended to be comprehended within the meaning and range of equivalents of the disclosed exemplary embodiments and may be substituted without•departing from the true spirit and scope of the invention.

It is also noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. An pressure reducing component for a firearm, comprising:

an upper receiver having a forward assist aperture and a forward assist cover;

at least one vent aperture formed through said forward assist cover; and a rotatable adjuster positioned within said forward assist aperture, wherein said rotatable adjuster comprises:

a tubular body portion extending from a top end to a bottom end and having an aperture formed through said tubular body portion;

a head portion extending from said top end of said tubular body portion;

a body extension portion extending from said bottom end of said tubular body portion; and wherein said rotatable adjuster is rotatable within said forward assist aperture between an open position and a closed position, and wherein said body extension portion does not occlude said at least one vent aperture when said rotatable adjuster is in said open position and wherein said body extension portion at least partially occludes said at least one vent aperture when said rotatable adjuster is in said closed position.

2. The pressure reducing component of claim 1, further comprising a plurality of vent apertures formed through said forward assist cover.

3. The pressure reducing component of claim 1, wherein said at least one vent aperture is formed proximate a bottom portion of said forward assist cover.

4. The pressure reducing component of claim 1, wherein said at least one vent aperture is formed so as to allow gases to escape from said forward assist aperture through said at least one vent aperture.

5. The pressure reducing component of claim 1, further comprising a cover element pivotably attached or coupled to said upper receiver, wherein said cover element is pivotable between an open position and a closed position, and wherein said cover element at least partially covers said at least one vent aperture when said cover element is in said closed position.

6. The pressure reducing component of claim 5, wherein said cover element is pivotably attached or coupled to said upper receiver above said at least one vent aperture.

7. The pressure reducing component of claim 5, wherein said cover element is pivotably attached or coupled to said upper receiver below said at least one vent aperture.

8. The pressure reducing component of claim 5, wherein said cover element is spring biased to said closed position.

9. The pressure reducing component of claim 1, wherein said rotatable adjuster includes at least one roll pin slot formed in said tubular body portion, wherein said roll pin slot allow said rotatable adjuster to be maintained within said forward assist aperture by interaction of said roll pin slot with a roll pin.

* * * * *